United States Patent [19]

Baugh et al.

[11] Patent Number: 5,038,860

[45] Date of Patent: Aug. 13, 1991

[54] HYDRAULICALLY ACTUATED LINER HANGER

[75] Inventors: J. Lindley Baugh, Houston, Tex.; Robert M. Shivers, III, Patterson, La.

[73] Assignee: Baker Hughes Incorporated, Houston, Tex.

[21] Appl. No.: 431,302

[22] Filed: Nov. 3, 1989

Related U.S. Application Data

[63] Continuation of Ser. No. 325,235, Mar. 16, 1989, abandoned.

[51] Int. Cl.[5] ..... E21B 23/04

[52] U.S. Cl. ..... 166/208; 166/212; 166/382

[58] Field of Search ..... 166/208, 212, 217, 120, 166/123, 124, 382, 88

[56] References Cited

U.S. PATENT DOCUMENTS

| | | | |
|---|---|---|---|
| 3,291,220 | 12/1966 | Mott | 166/212 X |
| 3,999,605 | 12/1976 | Braddick | 166/212 |
| 4,067,062 | 1/1978 | Bangh | 166/208 X |
| 4,067,388 | 1/1978 | Mouret | 166/212 X |
| 4,249,601 | 2/1981 | White | 166/212 X |
| 4,391,325 | 7/1983 | Baker et al. | 166/212 X |
| 4,624,311 | 11/1986 | Goad | 166/212 X |
| 4,688,642 | 8/1987 | Baker | 166/212 X |

*Primary Examiner*—Stephen J. Novosad

[57] ABSTRACT

A hanger for suspending a liner in a cased subterranean well comprises an elongated tubular body having ramp elements formed on its exterior and a plurality of peripherally spaced slip elements secured to a sleeve piston surrounding the lower end of the tubular body. Seals provided intermediate the piston and the tubular body define a first fluid pressure chamber. A clean fluid is supplied to the first pressure chamber through an axially extending passageway of restricted diameter provided in the wall of the tubular body and having an opening at its bottom end communicating with the first pressure chamber and at its top end communicating with a second pressure chamber defined by a tubing carried run-in tool detachably engaged with the liner hanger. The two pressure chambers and the restricted diameter passage are filled with clean fluid at the surface and pressure is applied to the clean fluid through an isolating piston mounted in the second fluid pressure chamber and actuated by non-clean fluids supplied through the tubular string upon which the run-in tool is suspended.

9 Claims, 8 Drawing Sheets

HYDRAULICALLY ACTUATED LINER HANGER

This is a continuation, of application Ser. No. 325,235 filed Mar. 16, 1989, now abandoned.

BACKGROUND OF THE INVENTION

1. Field of the Iinvention:

The invention relates to a hanger for suspending a liner in a cased subterranean well, and particularly to a hydraulically actuated linear hanger.

2. Background of the Invention:

Liner hangers have long been utilized in cased wells to suspend a linear extending from approximately the end of the casing to the bottom of the particular well. Such liners are suspended from the casing by a plurality of peripherally spaced slips which are forced into biting engagement with the internal wall of the casing by axial movement relative to ramps provided on the exterior of the tubular body of the liner hanger. Such relative movement has, in the past, been provided by hydraulic means actuated by pressured fluid supplied from the well surface.

All of the prior art hydraulically actuated liner hangers have required that one or more radial ports be provided in the liner hanger to transmit fluid pressure to an actuating piston disposed on the exterior of the liner hanger. Thus, when the hanger is set, seals must be provided in straddling relationship to the radial ports to prevent well fluids from flowing through such ports from the bore of the suspended liner into the well annulus surrounding the liner. Such seals are exposed to well fluids and are subject to rapid deterioration due not only to the corrosive effects of well fluids, but also due to recurrent axial stresses imposed on the seals by movements of well fluids in an upward direction and movement of treatment fluids in a downward direction.

It is therefore highly desirable that a hydraulically actuated line hanger be provided which does not result in radial ports extending through the body of the liner hanger. There is the further problem with prior art hydraulically actuated liner hangers in that the fluid utilized to effect the hydraulic setting of the hanger is readily contaminated by well fluids. The adverse effects of trash and corrosive elements of well fluids on hydraulically operated mechanisms is well known to those skilled in the art.

SUMMARY OF THE INVENTION

A liner hanger embodying this invention comprises an elongated tubular body which is detachably connectable at its upper end to a running-in tool, which, in turn is connected to a tubing string. At a medial portion of the tubular body, ramp elements are provided on its exterior. These ramp elements are co-operable with a plurality of peripherally spaced slip elements which in turn are operably connected to a sleeve piston surrounding the lower portions of the tubular body. Seal means are provided intermediate the sleeve piston and the cylindrical exterior surface of the tubular body to define an annular fluid pressure chamber. This chamber communicates with an axially extending small diameter fluid passage provided in the wall of the tubular body and extending to a bore opening in the tubular body adjacent the upper end of such body. The bore opening communicates with a second fluid pressure chamber which is defined between the bore of the tubular body and a cylindrical body portion of a running tool which is detachably connected to the upper end of the tubular body. An isolating piston is provided in the second annular pressure chamber so that such chamber, the axially extending small diameter fluid passageway and the lower pressure chamber may all be filled at the well surface with an isolated clean fluid. The opposite face of the isolating piston is in communication with the bore of the tubing string upon which the running tool is carried. Thus, increasing the fluid pressure within the running tool after dropping a ball upon a ball seat provided in the bore of the tool, will cause a pressure force to be exerted on the isolating piston which in turn is transmitted to the clean fluid and thence to the sleeve piston at the lower end of the tubular body. The resulting axial movement of the sleeve piston effects relative movement of the slips with respect to the ramp elements and causes the slips to be expanded into biting engagement with the casing wall.

After the liner hanger is set, the running tool is detached from the upper end of the tubular body, as by left hand rotation of a threaded connection, and the running tool, together with the upper fluid pressure chamber and the compensating piston are removed from the well. This action does not, however, effect an opening of a passageway between the bore of the tubular body and the surrounding well annulus since the longitudinally extending small diameter passageway remains filled with clean fluid. The actuating piston remains in the well, but does not interfere with fluid flow through the well since it is disposed on the exterior of the tubular body and provides protection for the seal elements mounted between the interior of the actuating sleeve piston and the external surface of the tubular body.

A particular feature of this invention is the construction of the small diameter axially extending passage in the wall of the tubular body. Preferably, this passage is formed by first machining a longitudinally extending groove in the exterior surface of the tubular body, then laying a pipe defining the desired small diameter fluid passage in such groove. The pipe is then covered and the remaining space in the groove is filled through the application of any common metallic solder or a welding or braising material. Following this, the lower portions of the tubular body are remachined to provide a true cylindrical surface with which the seal elements for the sleeve piston can effectively cooperate.

Further advantages of the method and apparatus of this invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
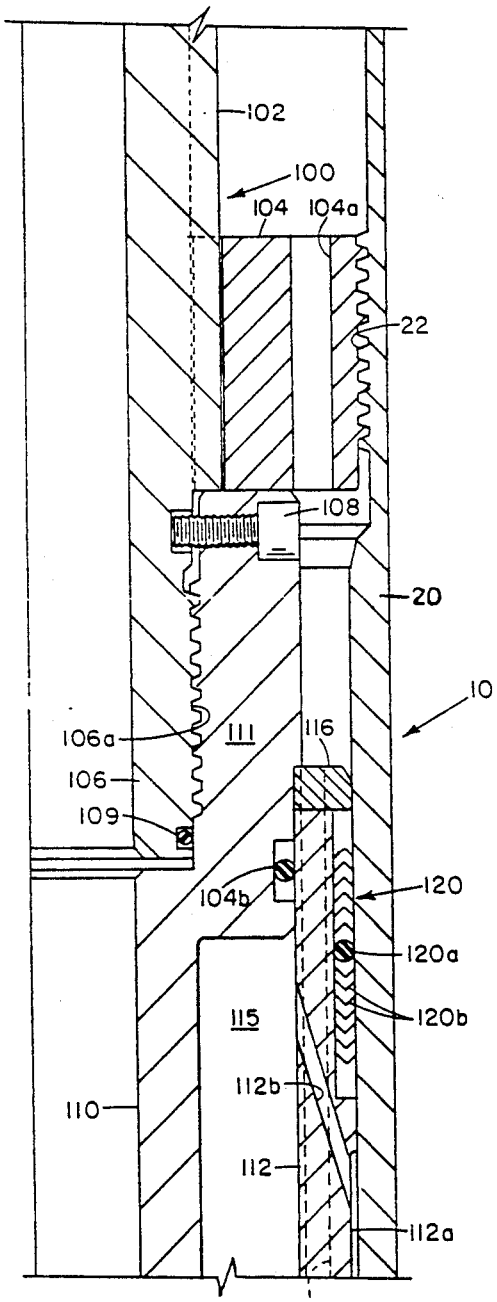
FIGS. 1A, 1B, . . . 1G collectively constitute a vertical quarter sectional view of a liner hanger embodying this invention with the elements thereof shown in their run-in position.
Figure 2A:
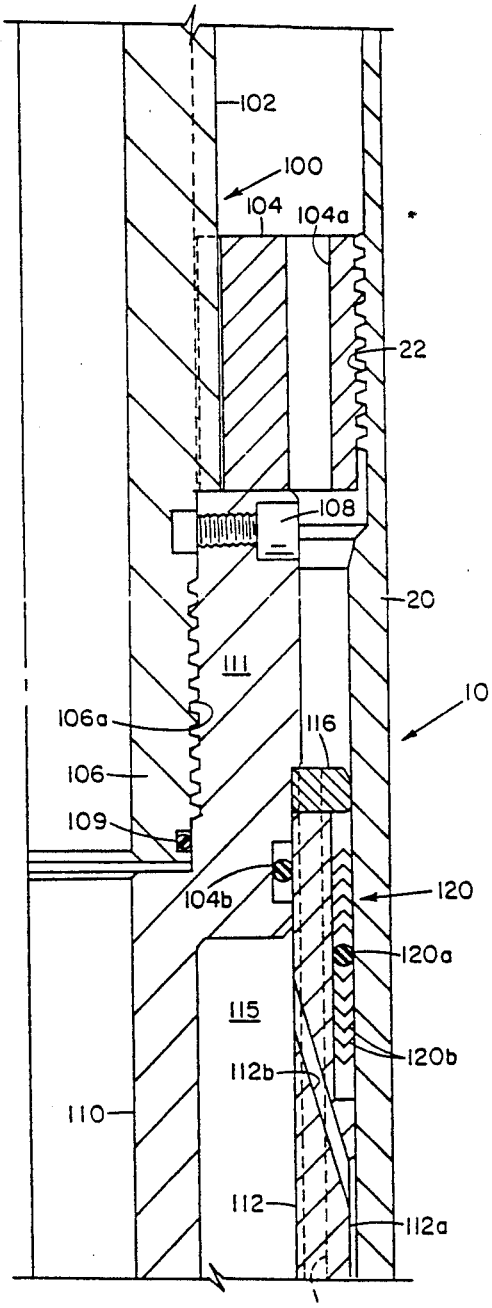
FIGS. 2A, 2B, . . . 2G comprises views respectively similar to FIGS. 1A, 1B, . . . 1G but showing the elements of the liner hanger in their set position.
Figure 1B:
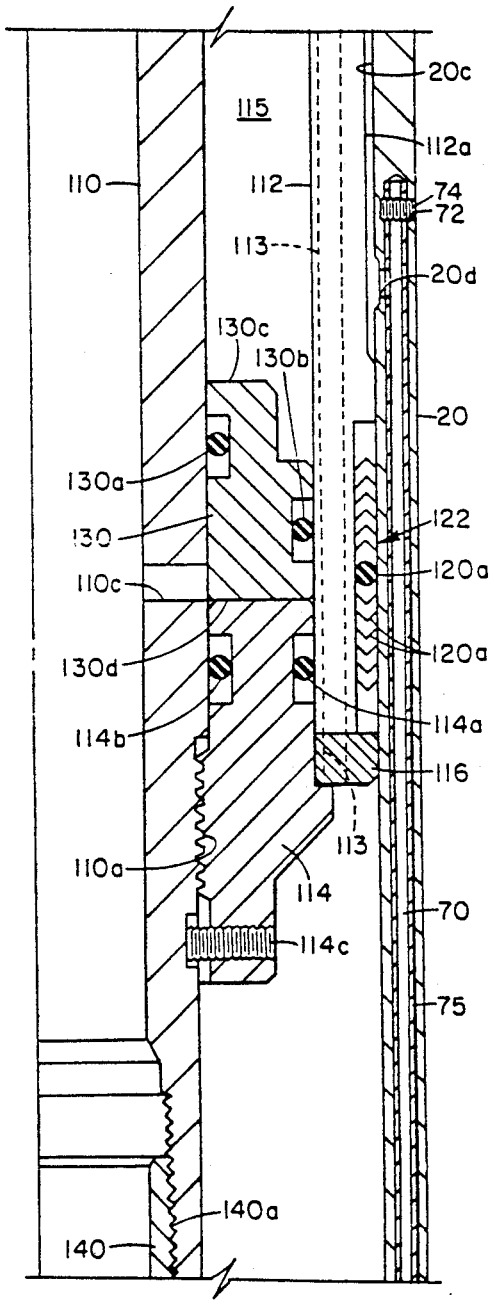
Figure 2B:
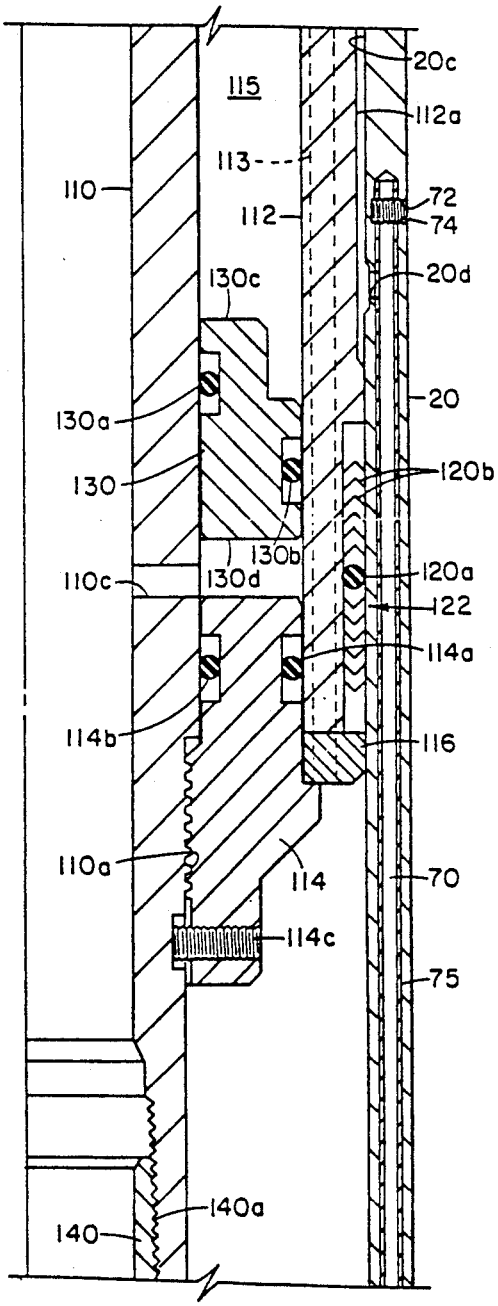
Figure 1C:
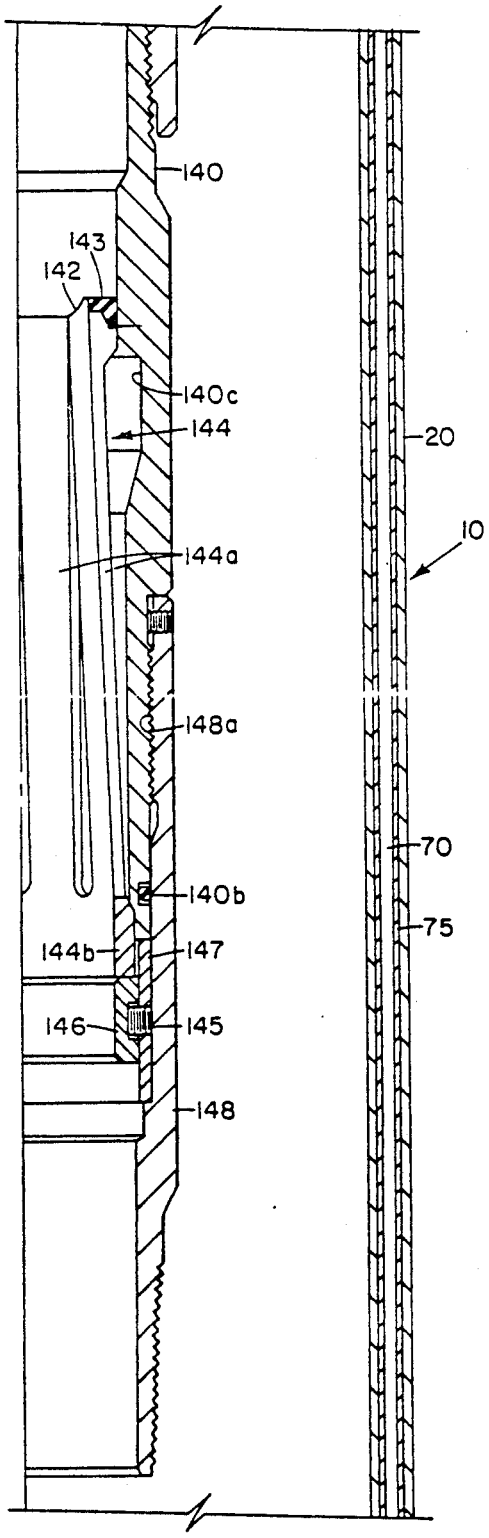
Figure 2C:
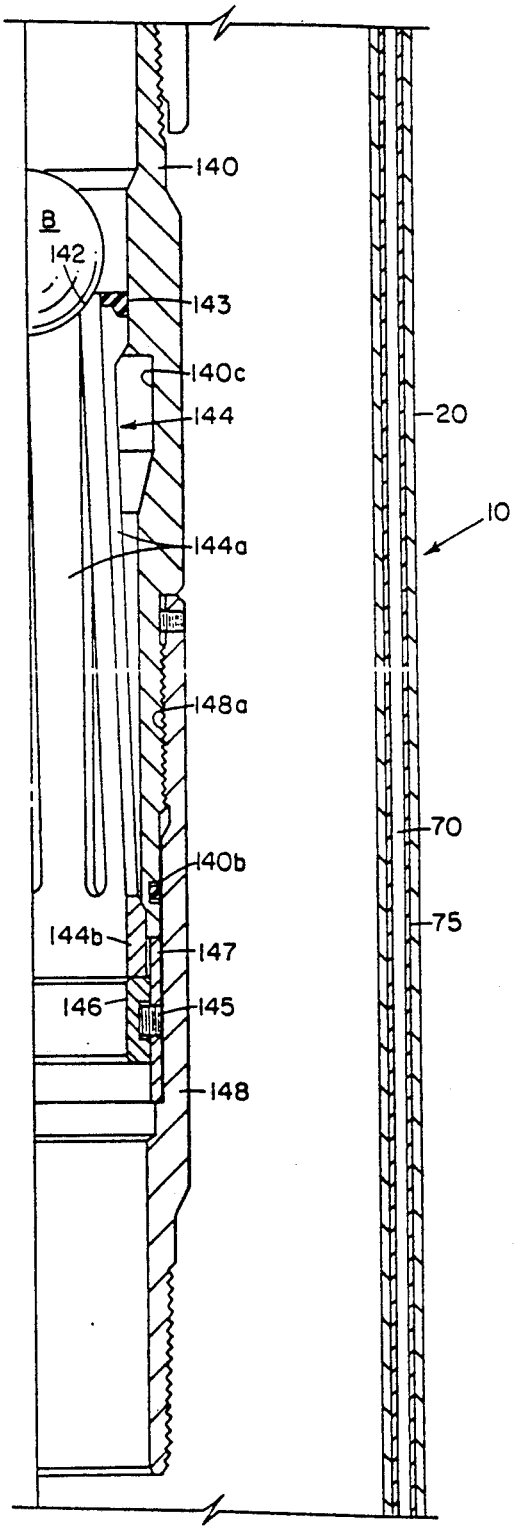
Figure 1D:
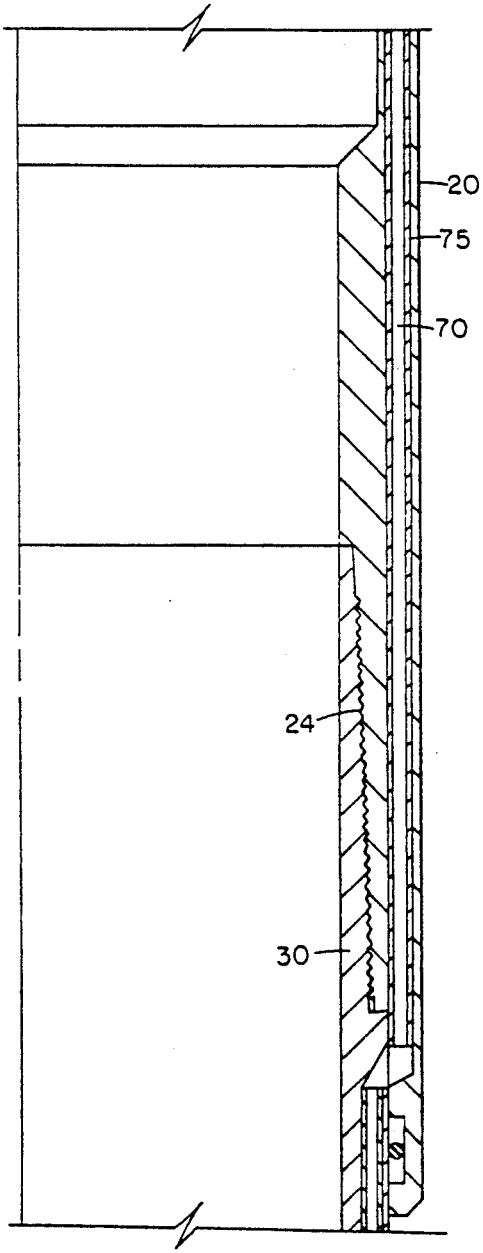
Figure 2D:
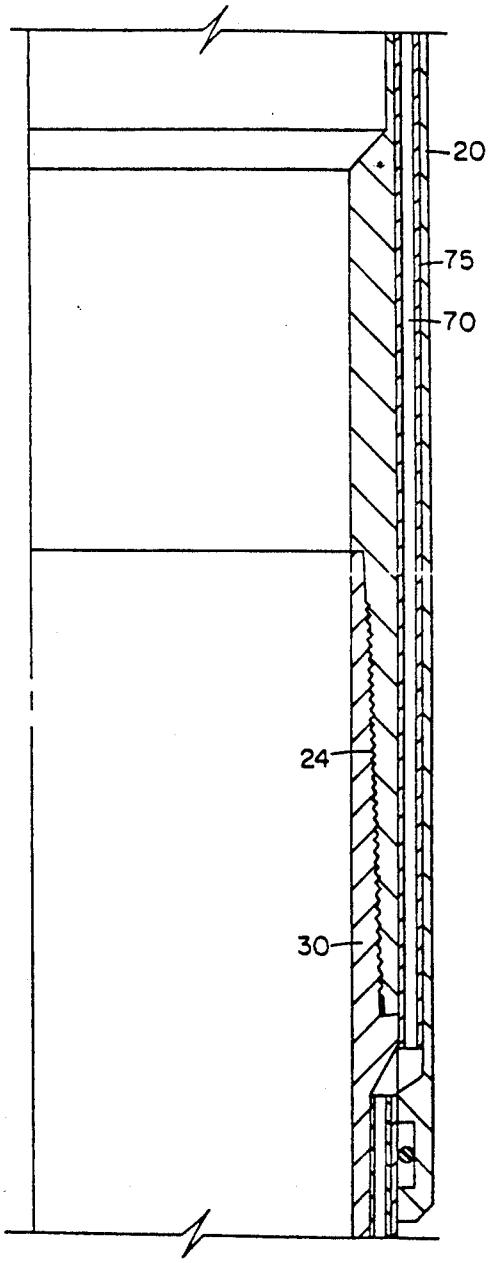
Figure 1E:
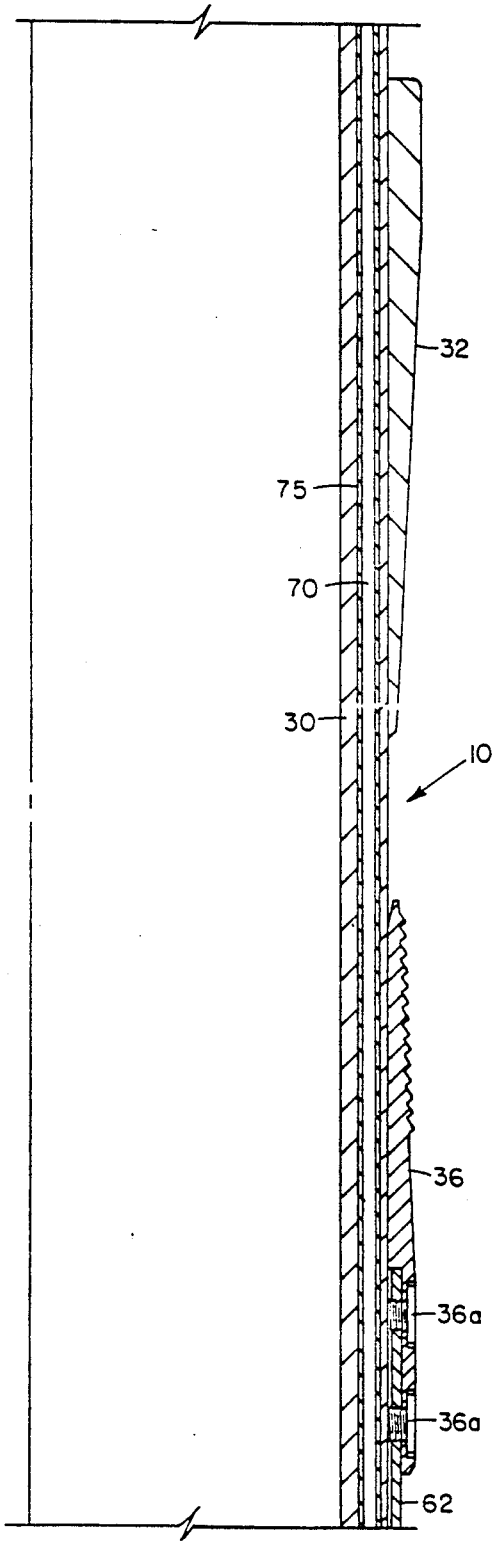
Figure 2E:
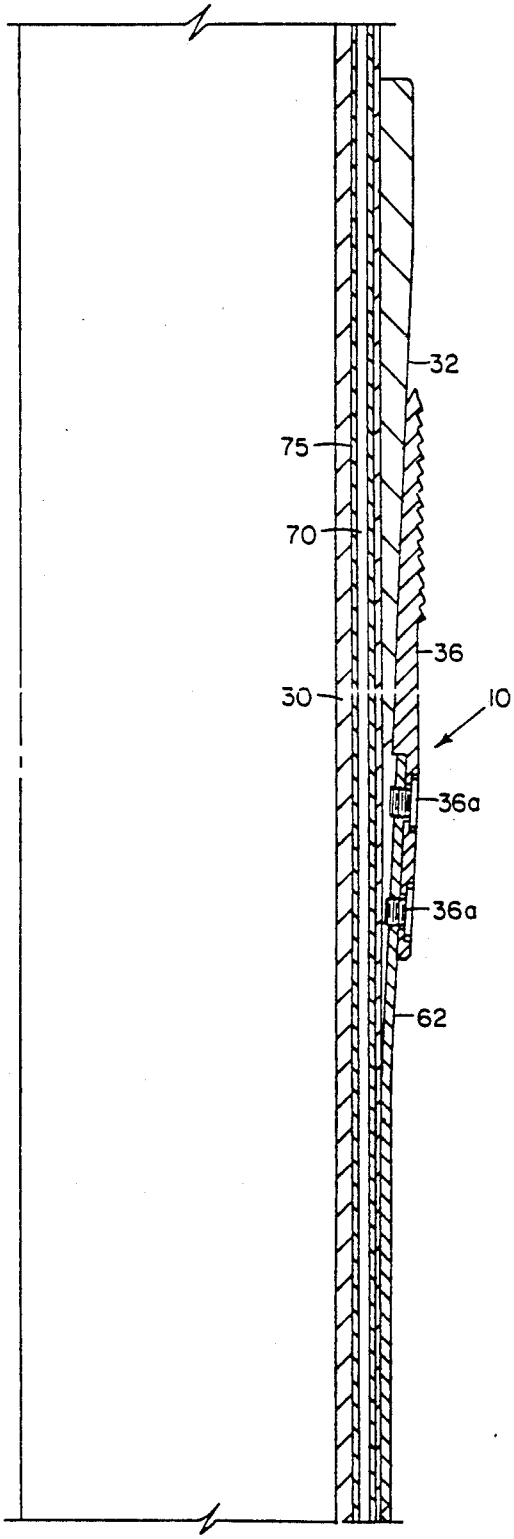
Figure 1F:
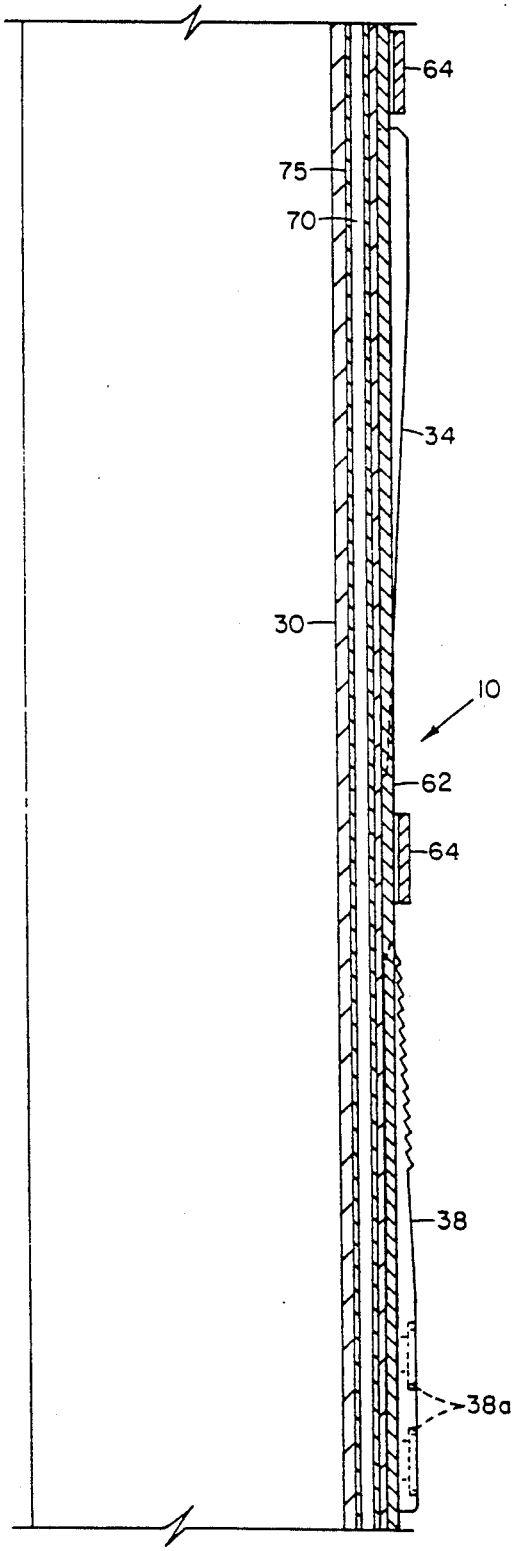
Figure 2F:
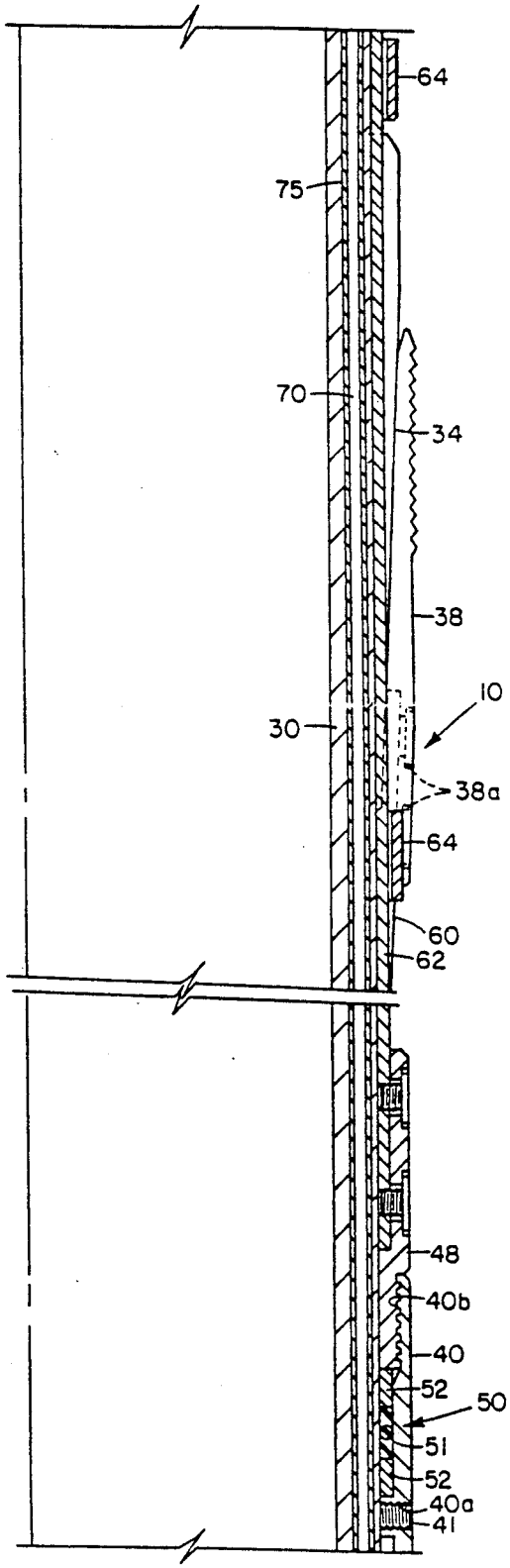
Figure 1G:
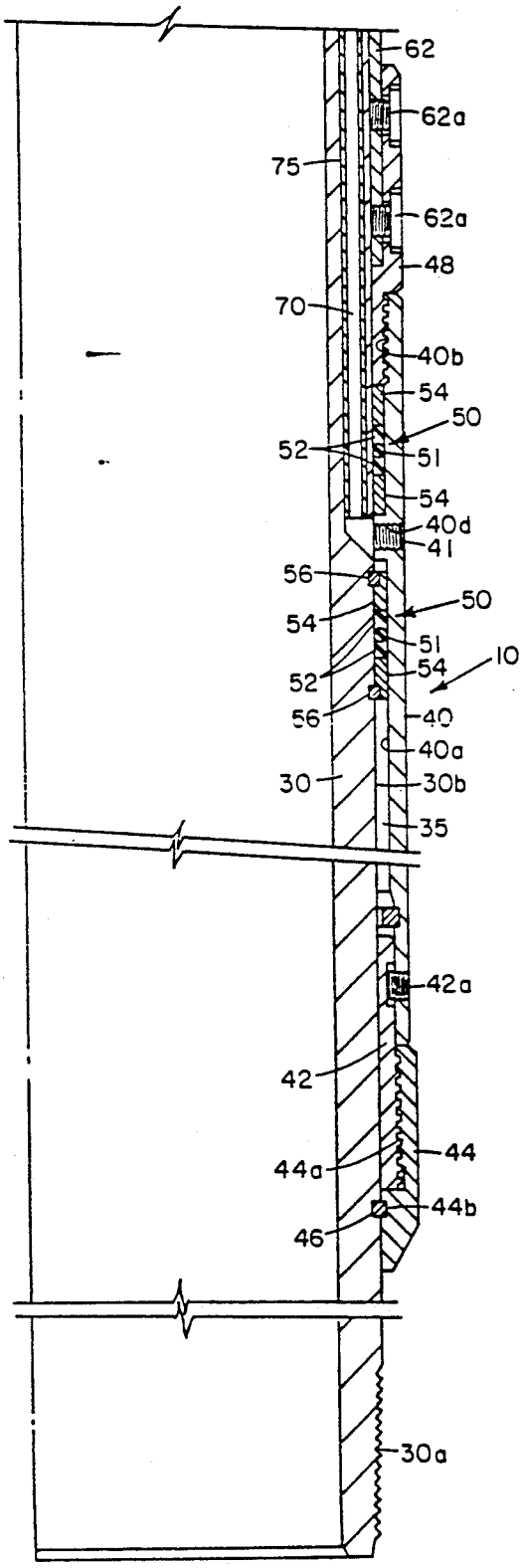
Figure 2G:
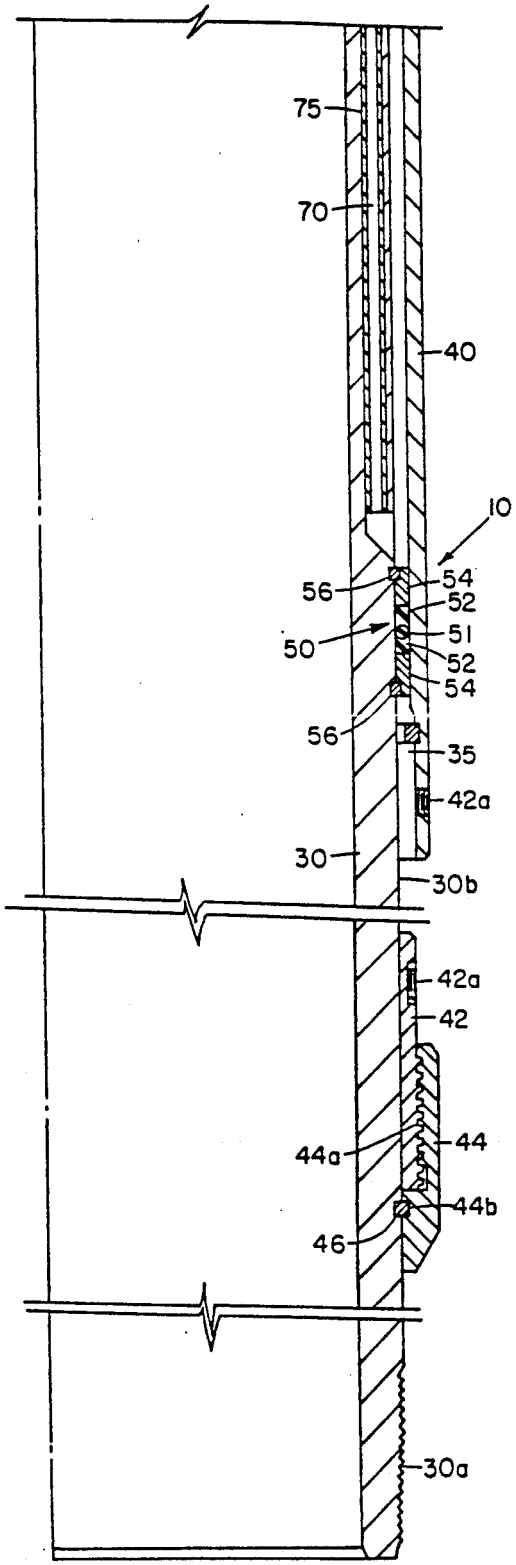

Referring to FIGS. 1A–1G, a liner hanger embodying this invention comprises an elongated tubular body assemblage 10 consisting of an upper body part 20 which is provided with internal threads 22 at its upper end for detachable securement to a tubing carried running tool 100. The lower end of upper body part 20 of the tubular body assemblage 10 is provided with internal threads 24 for engagement with a lower body part 30. Lower body part 30 is provided with external threads **30*a*** at its bottom end for sealed securement to a liner string which is to be inserted in the well casing (not shown) and anchored thereto by the liner hanger embodying this invention.

The upper portions of the lower body part 30 is provided with two vertically spaced sets of three peripherally spaced ramps or cone segments 32 and 34 which are welded or otherwise rigidly secured to the exterior of the lower tubular body part 30. Ramps 32 and 34 respectively cooperate with peripherally spaced sets of slips 36 and 38 which are axially movable with respect to the ramps 32 and 34 by a sleeve piston 40 which surrounds the lower end of the lower tubular body part 30. The upper ramps 32 and upper slips 36 are actually angularly displaced by 120° from the lower ramps 34 and lower slips 38 but for convenience of illustration are shown in the drawings as being angularly aligned.

The inner bore **40*a* of sleeve piston 40 is radially spaced from the external surface 30*b* of the lower tubular body part 30 to define an annular chamber 35. The lower end of sleeve piston 40 is secured to a sleeve 42 by one or more shear screws 42*a*. Sleeve 42 is in turn secured against axial movement relative to the lower tubular body part 30 by an anchor sleeve 44 which is has internal threads 44*a* engaging external threads on the sleeve 42 and defines a recess 44*b* for accommodating a C-ring 46 which is engaged in a suitable groove provided in the lower tubular body part 30**.

A pair of substantially identical annular seal units 50 are mounted in the annular chamber 35. Each seal unit comprises an O-ring 31 surrounded on both sides by a ring 52 of extrusion resistant plastic material, such as a tetrafluorcarbon sold under the trademark "Teflon". Metallic backup rings 54 are then provided in abutting relationship to the Teflon rings 52. The lowermost seal unit 50 is anchored to the lower tubular body part 32 by a pair of C-rings 56 which engage suitable grooves provided in the external surface **30*b* of the lower tubular body part 32. The upper seal unit 50 is slidable relative to external surface 30*b* of lower body part 30 and thus functions as a piston and also defines a fluid pressure chamber 55 between the two seal units 50. Upper piston seal unit 50 is shown in enlarged detail in FIG. 4**.

Figure 4:
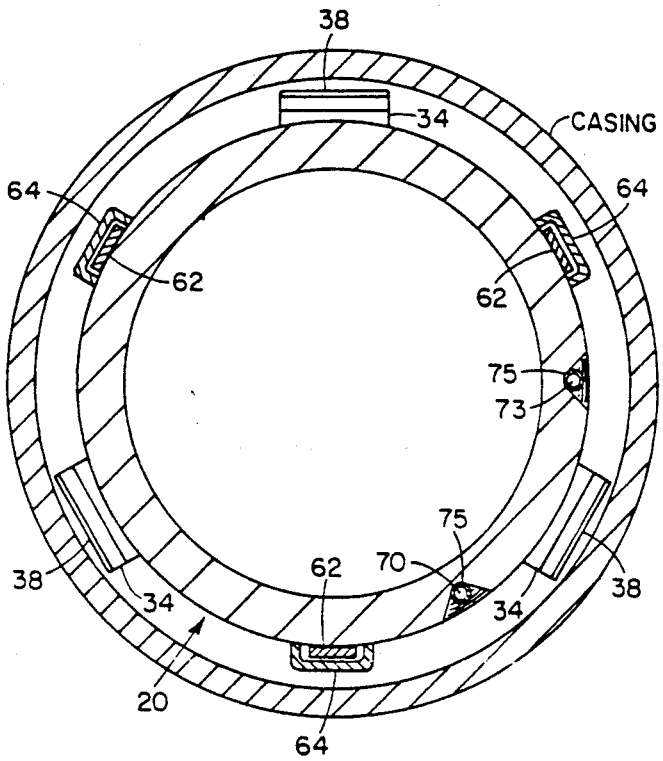
FIG. 4 is a perspective view of the slip and ramp elements.
Figure 5:
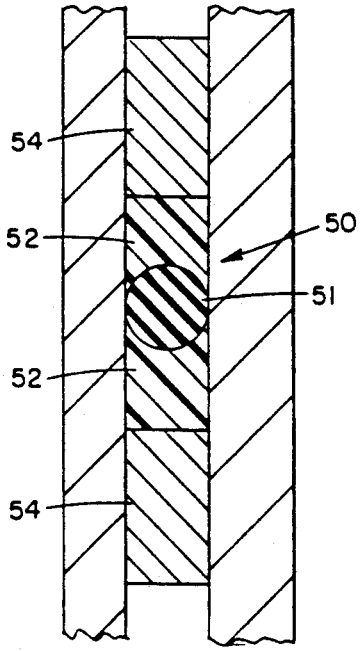
FIG. 5 is an enlarged sectional view of the piston seal element.

The upper end of sleeve piston 40 is provided with internal threads **40*b* which are engaged with the bottom end of a connecting sub 48 which in turn is secured by bolts 48*a* to a slip actuating mechanism, the configuration of which is best shown in FIG. 4 and is similar to that described and illustrated in U.S. Pat. No. 4,096,913. Thus, a sub 48 has three peripherally spaced, axial extensions 62 secured thereto by bolts 62*a* and respectively disposed intermediate the lower slips 38 and extending upwardly beyond the lower ramp 34 to be secured by bolts 36*a* to the three upper slips 36. C-shaped brackets 64 are welded to the exterior of lower body part 30 in surrounding relationship to the extensions 62 of the actuating sleeve 60 in order to guide the movements thereof. The lower slips 38 are secured by bolts 38*a* to the straps 60 secured by bolts 60*a* to sub 48**.

Thus, upward movement of the piston sleeve 40 produced by piston seal 50 will result in concurrent upward movement of the lower slips 38 and the upper slips 36 into respective engagement with the lower ramps 34 and the upper ramps 32, thus urging such slips outwardly into biting engagement with the inner wall of the casing (not shown) to effect the setting of the hanger. An upward force is applied to piston seal 50 by pressure applied to a clean fluid pressure chamber 55.

Pressured fluid is supplied to the clean fluid pressure chamber 55 in a unique manner. An axially extending, small diameter fluid passage 70 is provided in the wall of the tubular body 1 extending from a point communicating with the fluid pressure chamber 55 upwardly through the lower tubular part 30, thence through the upper tubular part 20 and terminating in the upper end of the upper tubular part 20 adjacent the running tool 100.

Figure 3:
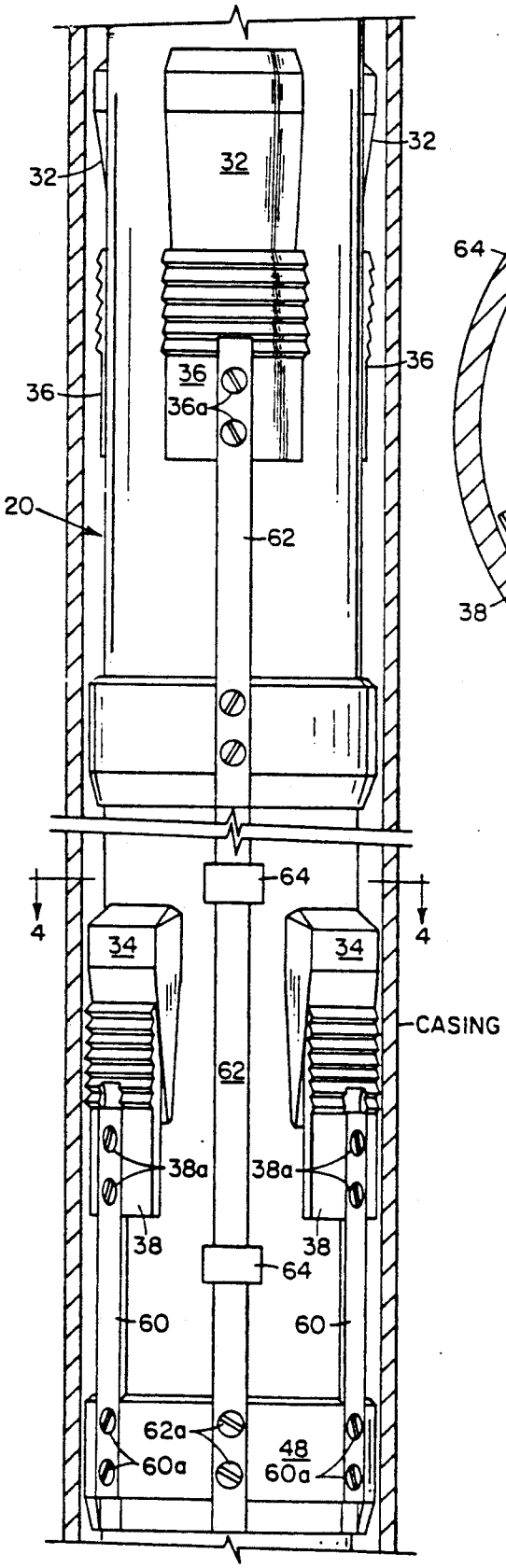
FIG. 3 comprises a partial sectional view taken on the plane 3—3 of FIG. 1C.

Such tubular passage may be provided by the gun drilling process but is preferably formed in the manner indicated in FIG. 3 by first forming an annular groove **10*a* in the exterior surface of the tubular body member 10, then laying a pipe 75 within such groove, and then surrounding the pipe with a metallic solder, braising or welding material. Hereinafter, such material will be merely referred to as a metallic solder. After application of the solder, the portion of the lower tubular part 30 that lies within the confines of the sleeve piston 40 in all of its positions is machined to a true cylindrical shape in order that the seal units 50** may effectively cooperate therewith.

The elongated axial passage 70 may be filled at the well surface with a clean fluid, such as kerosene, through a radial port 72 communicating with the upper end of the passage 70 and then closed by a plug 74. To permit the venting of air during the filling process, the fluid pressure chamber 55 may be provided with an appropriate venting port **40*b* provided in the sleeve piston 40 and closed by a plug 41. Alternatively, as illustrated in FIG. 3, a second axial passage 73 may be formed in parallel relationship to the first mentioned axial passage which is open at its upper end and communicates with the main axial fluid passage 70 in the vicinity of the fluid pressure chamber 55. The upper end of vent passage 73 may be closed by a radial port and a plug (not shown). In either event, the axially extending, small diameter fluid passage 70 and the fluid pressure chamber 55 is filled at the well surface with a clean fluid and an actuating force is supplied to the sleeve piston 40 by upper seal unit 50** through fluid pressure applied to the clean fluid at the upper end of the tool.

The running tool 100 comprises an upper tubular body portion 102 which mounts a conventional axially shiftable floating nut 104 which is engagable with the left hand internal threads 22 of the tubular body assemblage 10. An axial passage **104*a* prevents pressure buildup across floating nut 104. The running tool 100 is further provided with a reduced diameter lower extension 106 which is provided with external threads 106*a* for the mounting thereon of a sleeve-like element 110 which defines the inner wall of a fluid pressure chamber 115. A set screw or bolt 108 secures this threaded connection which is sealed by an O-ring 109**.

The outer wall of fluid pressure chamber 115 is defined by a cylindrical sleeve 112 which has its upper end sealably engaged with the upper end of the enlarged portion 111 of the inner wall 110 by an O-ring 104*b*. The lower end of outer wall 112 sealably engages a support sub 114 by virtue of an O-ring 114*a*. Support sub 114 is secured to external threads 110*a* provided on the inner wall 110. Such threads are sealed by an O-ring 114*b* and against disconnection by one or more set screws 114*c*.

At each end of the sleeve 112, a seal abutment ring 116 is provided which projects radially beyond the outer wall sleeve 112 to provide an abutment shoulder for upper and lower seal units 120 and 122. These seal units are of identical construction and involve a conventional array of O-rings 120*a* and stacked chevron seal elements 120*b* which sealably engage the inner bore wall 20*c* of the upper tubular part 20 of the tubular body assemblage 10. The seals 120 straddle one or more radial ports 20*d* which communicate with the top end of the axially extending, small diameter fluid passage 70. An annular recess 112*a* provided in the medial portions of the outer wall sleeve 112 plus an inclined, radially extending port 112*b* through such wall provides communication between the top end of fluid pressure chamber 115 and the axially extending small diameter fluid passage 70. The fluid pressure chamber 115 is thus filled with clean fluid at the well surface. One or more axial passages 113 are provided in outer wall sleeve 112 and seal abutment rings 116 to prevent any fluid pressure buildup.

Such clean fluid in the fluid pressure chamber 115 is isolated from contact with well fluids by an isolating piston 130 which has internal and external O-rings 130*a* and 130*b* respectively engaging the inner walls 110 and the outer walls 112 of the fluid pressure chamber 115. Thus, the upper face 130*c* of the isolating piston 130 is in contact with the clean fluid. The lower face 130*d* of the isolating piston 130 is in contact with fluids supplied through the running tool 100 and the tubing string upon which the running tool 100 is mounted, through one or more radial ports 110*c* provided in the inner wall portion 110 of the fluid pressure chamber 115 at a location near the bottom end of such fluid pressure chamber.

To apply fluid pressure to the isolated clean fluid, a ball seat 142 is provided within a ball seat sleeve 140 which is threadably secured by threads 140*a* to the bottom end of the inner wall portion 110. While the ball seat may comprise a simple upwardly facing inclined surface, it is preferred that the ball seat 142 be defined by the compressed ends of a collet 144 having spring arm portions 144*a* terminating in abutting head portions defining the ball seat 142 to receive a ball B. An elastomeric seal 143 surrounds such head portions. The ring portion 144*b* of collet 144 is secured in position by an annular ring 146 which in turn is secured by shear screws 145 to a sleeve 147 which lies in an annular recess 148*c* in a bottom coupling sleeve 148 which is secured by threads 148*a* to the bottom end of the ball seat sleeve 140. Threads 148*a* are sealed by O-ring 140*b*. Thus, if fluid pressure supplied through the tubing string (not shown) is increased to a level sufficient to effect shearing of shear screws 145, the ball seat collet 144 may be shifted downwardly to permit the collect heads to expand into an annular recess 140*c* and ball B may be discharged downwardly into the bottom of the well, if it is desired to completely open the passageway through the running tool 100.

In any event, when the ball B is dropped into engagement with the ball seat 142, the fluid pressure may be increased in the running tool 100 and this increased fluid pressure will produce an upward force on the isolation piston 130 which in turn is transmitted by the clean fluid in fluid pressure chamber 115 to the clean fluid in the axially extending small diameter fluid passage 70 and thence into the fluid pressure chamber 55 disposed within the sleeve piston 40. Such fluid pressure will effect an upward movement of the upper piston seal unit 50. Upper seal unit 50 abuts the bottom end of the connecting sub 48 to urge the actuating sleeve 60 upwardly and effect the expansion of the lower and upper slips 36 and 38 into biting engagement with the inner wall of the casing, thus setting the liner hanger.

After the liner hanger is set, the running tool 100 may be removed from engagement with the hanger by right hand rotation of the tubing string which effects an unthreading of the floating nut 104 and hence releases the running tool 100 from the tubular body assemblage 10. Removal of the running tool 100 will thus leave the port 20*d* communicating with the upper end of the small diameter fluid passage 70 in an open position, but no well fluids can enter this fluid passage due to the fact that it is entirely filled with clean fluid. Therefore there is no fluid passage through the wall of the hanger. Additionally, the seal units 50 are well protected from any adverse impacts due to the fact that they are always covered by the sleeve piston 40.

From the foregoing description, those skilled in the art will recognize that this invention provides a unique and advantageous method and apparatus for effecting the suspension of a liner in a well casing. While hydraulic actuation of the hanger embodying this invention is employed, the actuating fluid is entirely clean and free from the debris normally associated with well fluids. Moreover, after the setting of the hanger, and the removal of the running tool, there is no fluid passage left through the wall of the liner due to the fact that the axially elongated small diameter fluid passage 70 is completely with well fluid, and exits above the liner.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A liner hanger for a cased subterranean well comprising:

an elongated tubular body having a small diameter fluid passage in the wall thereof extending from a bore opening below the upper end of said tubular body to an opening in the exterior of the tubular body above the bottom end of said tubular body;

a running tool detachably secured to the upper end of said tubular body;

means in said running tool for pressurizing fluid in said fluid passage;

ramp means secured to the exterior of said tubular body adjacent said lower end of said tubular body;

a sleeve piston surrounding said lower end of said tubular body and defining an annular chamber communicating with said exterior opening of said fluid passage;

said small diameter fluid passage and said annular chamber being fillable at the well surface with a clean fluid;

seal means for applying a force derived from said pressured clean fluid to said sleeve piston to move said sleeve piston axially relative to said ramp means; and a plurality of peripherally spaced slips operably connected to said sleeve piston and movable thereby into engagement with said ramp means.

2. The apparatus of claim 1 wherein said running tool comprises:

a tubular assemblage insertable in and detachably connected to the upper end of said tubular body;

said tubular body assemblage having annular inner and outer walls defining a clean fluid pressure chamber therebetween;

port means in said outer wall communicating between one end of said clean fluid pressure chamber and said upper bore opening of said small diameter fluid passage;

an isolating piston sealably mounted in the other end of said clean fluid pressure chamber to isolate said clean fluid; and port means in said inner wall for supplying pressured fluid to said isolating piston to apply pressure to said clean fluid.

3. A liner hanger for a cased subterranean well comprising:

an elongated tubular body having a small diameter fluid passage in the wall thereof extending from a bore opening below the upper end of said tubular body to an opening in the exterior of said tubular body above the bottom end of said tubular body, said small diameter fluid passage being fillable at the well surface with a clean fluid;

a running tool detachably secured to the upper end of said tubular body;

piston means in said running tool for pressurizing said clean fluid;

ramp means secured to the exterior of said tubular body adjacent said lower end of said tubular body;

a sleeve piston surrounding said lower end of said tubular body;

a pair of vertically spaced seal units defining a fluid pressure chamber intermediate said sleeve piston and said tubular body and communicating with said exterior opening of said small diameter fluid passage for filling said fluid pressure chamber with said clean fluid;

means for securing one of said sealed units to said tubular body;

the other of said seal units being movable relative to said tubular body and operably connected to said sleeve piston; and a plurality of peripherally spaced slips operably connected to said sleeve piston and engagable with said ramp means by vertical movement of said sleeve piston produced by pressurization of said clean fluid.

4. The apparatus of claim 3 wherein said running tool comprises;

a tubular assemblage insertable in the upper end of said tubular body and having inner and outer walls defining a second fluid pressure chamber therebetween;

vertically spaced seals on said outer wall sealably engaging the bore of said tubular body respectively above and below the upper bore opening of said small diameter fluid passage;

port means in said outer wall communicating between one end of said second fluid pressure chamber and said upper bore opening of said small diameter fluid passage to permit filling of said second fluid pressure chamber with clean fluid;

an isolating piston sealably mounted in the other end of said fluid pressure chamber to isolate said clean fluid; and port means in said inner wall for supplying pressured fluid to said isolating piston to apply pressure to said clean fluid.

5. The apparatus of claim 3 or 4 wherein each of said seal units comprises an elastomeric O-ring mounted axially intermediate tetrafluorcarbon rings;

said tetrafluorcarbon rings being axially abutted by metallic rings.

6. The apparatus of claims 1, 2, 3 or 4 wherein said small diameter fluid passage comprises:

an axially extending groove in the exterior of said tubular member;

a pipe lying in said groove and defining said reduced diameter fluid passage;

a metallic solder covering said pipe and filling said groove; and said tubular member being machined to provide a cylindrical surface adjacent said sleeve piston.

7. The method of hydraulically setting a liner hanger in a well casing, said liner hanger comprising an elongated tubular body having ramp means on its exterior, a piston sleeve surrounding its lower portion, and peripherally spaced slips axially movable by said piston sleeve into operable engagement with said ramp means to expand into biting engagement with the well casing, comprising the steps of:

providing a small diameter fluid passage in the wall of said tubular body extending from a bore opening below the upper end of said tubular body to an exterior opening in said tubular body above the bottom end of said tubular body;

providing seal means intermediate the bore of said sleeve piston and the adjacent exterior surface of said tubular body to define an annular fluid pressure chamber communicating with said bottom exterior opening of said small diameter fluid passage;

filling said small diameter fluid passage and said annular pressure chamber at the well surface with a clean fluid; and applying pressure to the clean fluid in upper end of said small diameter fluid passage by an isolating piston to produce axial movement of said sleeve piston to set said slips.

8. The method of hydraulically setting a liner hanger in a well casing, said liner hanger comprising an elongated tubular body having ramp means on its exterior, a piston sleeve surrounding its lower portion, and peripherally spaced slips axially movable by said piston sleeve into operable engagement with said ramp means to expand into biting engagement with the well casing, comprising the steps of:

providing a small diameter fluid passage in the wall of said tubular body extending from a bore opening below the upper end of said tubular body to an exterior opening in said tubular body above the bottom end of said tubular body;

providing seal means intermediate the bore of said sleeve piston and the adjacent exterior surface of said tubular body to define an annular fluid pressure chamber communicating with said bottom exterior opening of said small diameter fluid passage;

providing a second annular fluid pressure chamber within said tubular body by a tubing carried running tool detachably secured to the upper end of said tubular body; said second annular fluid pressure chamber communicating with said upper bore opening of said small diameter fluid passage;

filling said first and second annular fluid pressure chambers and said small diameter fluid passage with clean fluid at the well surface; and positioning an isolating piston in said second annular fluid pressure chamber with one face of said isolating piston contacting said clean fluid and the other face contacting non-clean fluids supplied through the tubing carrying said running tool; and increasing the fluid pressure of said non-clean fluids on said isolating piston to axially shift said sleeve piston to set said slips.

9. The method of claim 8 further comprising the step of detaching and removing said running tool from said tubular body, whereby said small diameter fluid passage remains filled and closed by clean fluid.

* * * * *